United States Patent [19]

Focke

[11] 4,241,827

[45] Dec. 30, 1980

[54] PACKET HAVING SPACER MEMBERS

[75] Inventor: Heinz Focke, Verden, Fed. Rep. of Germany

[73] Assignee: Focke & Co., Verden, Fed. Rep. of Germany

[21] Appl. No.: 83,705

[22] Filed: Oct. 11, 1979

Related U.S. Application Data

[63] Continuation of Ser. No. 917,237, Jun. 20, 1978, abandoned.

[51] Int. Cl.[3] ..... B65D 85/10; B65D 5/50; A24F 15/00

[52] U.S. Cl. ..... 206/248; 229/44 CB

[58] Field of Search ..... 206/248, 45, 45.16, 206/45.2; 229/44 CB, DIG. 8

[56] References Cited

U.S. PATENT DOCUMENTS

| | | | |
|---|---|---|---|
| 1,953,418 | 4/1934 | MacDonald | 206/45 |
| 2,090,200 | 8/1937 | Hekman | 206/45.16 |
| 2,391,285 | 12/1945 | Williamson et al. | 206/45 |
| 3,081,867 | 3/1963 | Corey | 206/248 |
| 3,968,874 | 7/1976 | Corey | 206/248 |

FOREIGN PATENT DOCUMENTS

| | | | |
|---|---|---|---|
| 819205 | 9/1959 | United Kingdom | 229/44 CB |

*Primary Examiner*—William T. Dixson, Jr.
*Attorney, Agent, or Firm*—Sughrue, Rothwell, Mion, Zinn and Macpeak

[57] ABSTRACT

A packet formed from a blank and adapted to hold a block shaped article, such as a foil wrapped group of cigarettes is disclosed. The packet is adapted to hold an article having a height less than that of the packet by means of distance or spacer elements arranged in the region of the bottom wall. Various techniques for forming the elements in the context of the blank are disclosed.

5 Claims, 4 Drawing Figures

PACKET HAVING SPACER MEMBERS

This is a Continuation, of application Ser. No. 917,237, filed June 20, 1978, now abandoned.

BACKGROUND OF THE INVENTION

This invention relates to a packet of the kind made from a blank of stiff paper or cardboard or other foldable material for the formation of front, rear, bottom and side walls folded to parallelepipedic or rectangular prismatic form to contain a contents article of block form. The contents article may comprise cigarettes or other rod-shaped units enveloped in an inner wrapper, referred to herein as a tin foil block.

The invention is envisaged as useful mostly but not exclusively in the packing of cigarettes or small cheroots or whiffs. A cigarette packet is ordinarily such that a group of cigarettes therein form a contents article of block form with the cigarettes enveloped in an inner wrapper or foil to form a tin foil block which is accommodated in the packet made of paper or pasteboard for example. In the utilization of the packet for the withdrawal of cigarettes, after the packet is first opened, the inner wrapper is partially removed so that access to the cigarettes is free.

For the handling of the packet it is advantageous if the cigarettes within the packet always have a conventional or specific position in relation to the packet opening, that is in relation to the upper edge of the packet. This is valid both for cut-type packets and for hinged-lid packets, and is very important for the convenience of regular users of such packets.

Ordinarily the construction height of the packet is adapted to the length of the cigarettes or other articles to be packed. The tin foil block abuts on the bottom wall of the packet in such a way that, by reason of a resultant conventional or specific relative position in the packet the cigarettes can easily be taken from the packet. Numerous different length cigarettes are manufactured, however. Differences in length exist for example between cigarettes with and without filters. Furthermore especially long cigarettes and cigarettes shorter than these can be found on the market. For various reasons it can however be expedient for a manufacturer or vending machine operator to use uniform packet sizes.

The invention is therefore intended to provide a packet for cigarettes for example, in which a packet contents article which is shorter in comparison with the dimensions of the packet is held in the packet in such a way that a conventional relative position between one end of the packet contents article and packet exists in the region of the opening of the packet.

According to the invention a packet is characterized in that distance pieces are arranged in the region of the bottom wall to hold or support the contents article of block form (tin foil block) at a distance from the bottomwall.

Thus a contents article having a height less than that of the packet is supported at a distance from the bottom wall in such a way that in the region of the packet opening there is a desired relative position, making possible easy access to the packet contents. The distance pieces are preferably formed integrally from the packet blank, and may conveniently be inwardly folded flaps or tabs. In the case of a packet having walls which comprise a plurality of layers in individual zones, the distance pieces can be formed advantageously by inwardly situated layers, that is, layers which are covered to the exterior.

The invention may be put into practice as explained hereinafter by reference to two examples of the preferred embodiment illustrated in the accompanying drawings, in which:

DESCRIPTION OF THE PREFERRED EMBODIMENT

Figure 1:
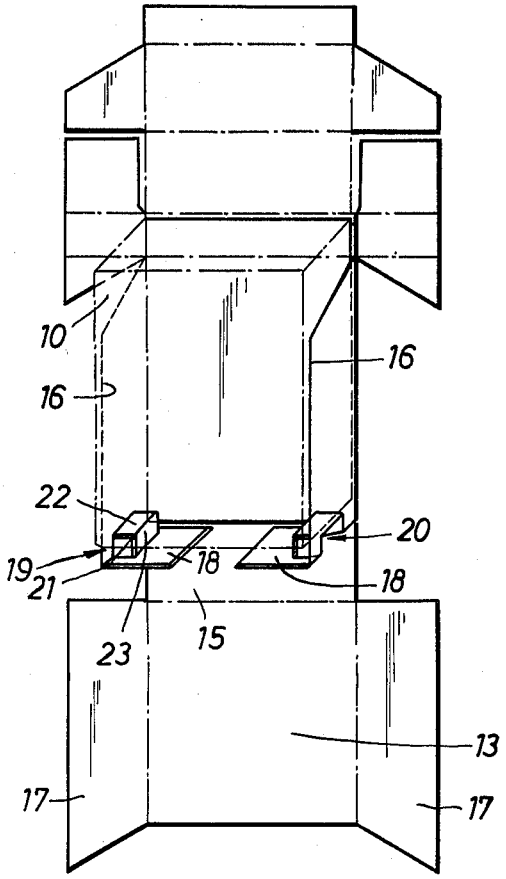
FIG. 1 shows a partly folded blank for a hinged lid packet with a packet contents article.

FIG. 1 shows a group of cigarettes enveloped by an inner wrapper to make a tin foil blank forming the packet contents article 10 of block form.

Each illustrated packet consists of a blank of cardboard or stout paper. Individual areas are defined or bounded on the blanks by cuts and longitudinally and transversely directed fold lines 11 and 12, these areas serving for the formation of a front wall 13, a rear wall 14, a bottom wall 15 and two side walls. Each of the two side walls is formed by the connection of two overlapping side flaps 16 and 17 respectively adjoining the front wall 13 and the rear wall 14. These side flaps 16 and 17 substantially completely overlap one another in the complete packet, and are connected together by adhesive. In the region of the bottom wall 15 a corner flap 18 is provided on each of the two side flaps 16. During the wrapping of the packet contents article 10 the flaps are folded inwards so that the corner flaps 18 rest on the inside of the bottom wall 15, are connected by adhesive.

In the upper zone further flaps for the conventional formation of a hinged lid adjoin the rear wall 4.

As shown the packet contents article 10 has a height less than that of the packet. In order nevertheless to guarantee a specific relative position of the packet content 10 in the packet distance pieces 19 and 20 are provided in the bottom zone of the packet. The packet contents 10 is supported at a distance from the bottom wall 15 on the distance pieces 19, 20. In the present examples of the preferred embodiment they are arranged in the corners formed by the side walls and bottom wall 15.

In both the illustrated embodiments, the distance pieces 19 and 20 are formed by integral portions of the packet. In the preferred example of embodiment according to FIGS. 1 and 2 a support 21 of angular cross-section comprising two portions 22 and 23 at right-angles to each other is folded inwards in the region of the corners between the side walls and the bottom wall 15. The first-mentioned support portion 22 is part of the respective inner side flap 16 of the side wall and is directed horizontally. The upright support portion 23 is part of the respective corner flap 18.

Figure 2:
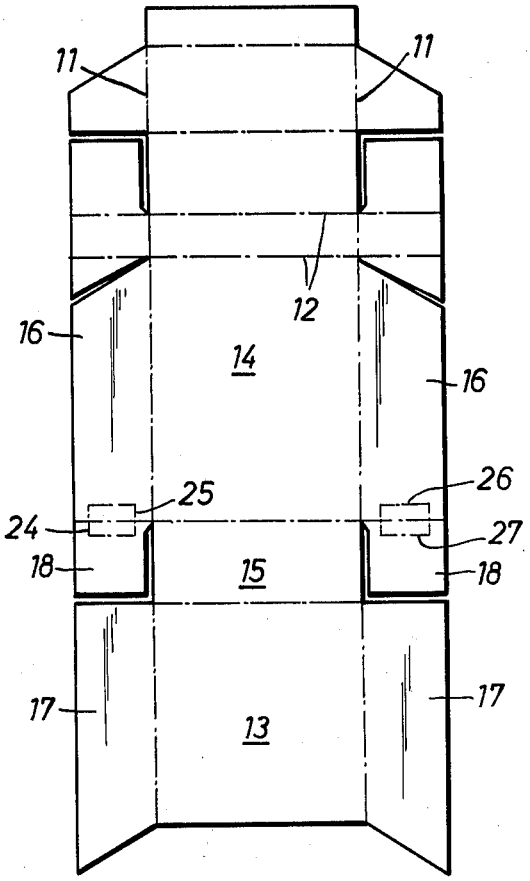
FIG. 2 shows the blank of FIG. 1, spread out with punchings for the formation of distance pieces.

These distance pieces 19 and 20 according to FIGS. 1 and 2 are preformed or defined in the flat blank according to FIG. 2 by punch cuts 24 and 25 extending approximately parallel with the longitudinally directed fold lines 11 and by expediently formed transversely extending fold markings 26 and 27. A common middle fold edge of these two distance pieces 19 and 20 is predetermined by one of the transverse fold lines 12. During the folding of the blank according to FIG. 1 into the position according to FIG. 2, the blank portions 22 and 23 for the formation of the distance pieces 19 and 20 are merely pressed inwards by appropriate folding members. Thus the angular supports 21 are independently shaped.

Figure 3:
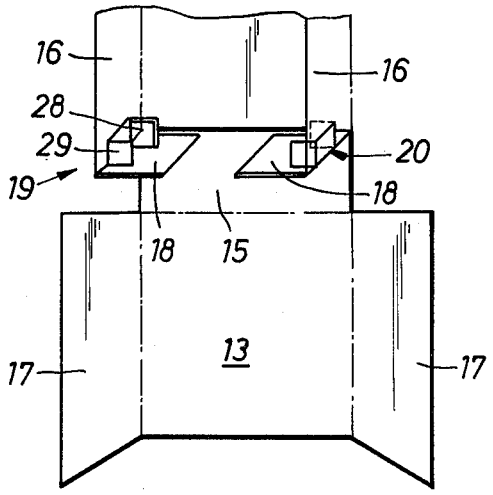
FIG. 3 shows parts of a second partially folded blank.
Figure 4:
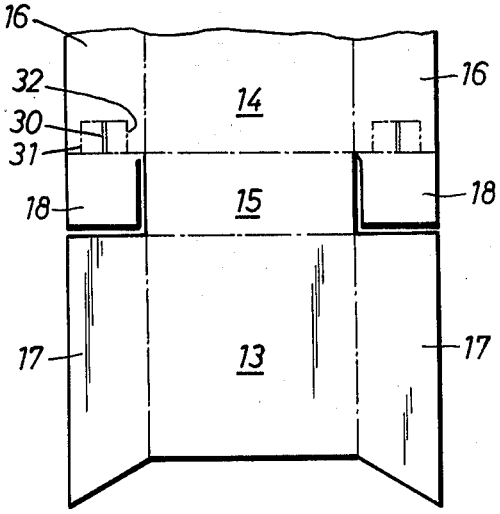
FIG. 4 shows parts of the blank of FIG. 3 spread out.

In the example of embodiment according to FIGS. 3 and 4 each of the distance pieces 19 and 20 consists of two support tabs 28 and 29 formed by portions integral with inner side flaps 16. These tabs 28 are pressed inwards after the manner of the opening of a double door.

According to FIG. 4 the blank is preformed for these distance pieces 19 and 20 by two triple punch cuts 30 and fold markings 31 and 32 adjoining the respective ends of the transverse punch cuts. The distance pieces 19 and 20 are formed exclusively by portions of the side flaps 16.

In each instance the apertures which occur in the blank parts due to the provision of the distance pieces 19 and 20 are covered by the external side flaps 17 and by the bottom wall 15 in the finished packet.

What we claim is:

1. A packet for block-shaped articles, particularly cigarette groups or the like, said articles wrapped in an inner folded blank made of stiff paper, cardboard or other foldable material, having front, rear, bottom and side lateral walls to define a packet, the improvement comprising:

said lateral walls of said packet each comprise two lateral flaps folded on top of each other;

a folded-over corner flap connected with an inner one of said lateral flaps and located at the inner side of said bottom wall;

said block-shaped article supported away from said bottom wall by spacer means arranged in the area of said bottom wall;

said spacer means arranged in corners formed by said bottom wall and said lateral wall; and said spacer means each exclusively formed by supporting flaps folded towards the inside of said packet and formed by a double-T-shaped punching cut in said inner lateral flap.

2. The packet as in claim 1, wherein said flaps are formed in both inner lateral stops.

3. The packet as in claims 1 or 2 wherein said flaps are supported by said bottom wall.

4. A packet for block-shaped articles, particularly cigarette groups or the like, said articles wrapped in an inner folded blank made of stiff paper, cardboard or other foldable material, having front, rear, bottom side lateral walls, to define a packet the improvement comprising:

said lateral walls of said packet each comprising two lateral flaps folded on top of each other;

a folded-over corner flap connected with an inner one of said lateral flaps and located at the inner side of said bottom wall;

said block-shaped article is supported away from said bottom wall by spacer means arranged in the area of said bottom wall;

said spacer means arranged in corners formed by said bottom wall and said lateral wall; and said spacer means each exclusively formed by angular supporting flaps folded towards the inside of said packet which are formed by two punching cuts arranged at a predetermined distance from each other in said inner lateral flap and in said folded-over corner flap.

5. The packet as in claim 4, wherein said spacer means comprise a two part fold support folded inward along a fold line of said folded blank to form said bottom wall.

* * * * *